US010285487B2

(12) United States Patent
Lee

(10) Patent No.: US 10,285,487 B2
(45) Date of Patent: May 14, 2019

(54) LIP BALM APPLICATOR

(71) Applicant: Jeff Lee, Folsom, PA (US)

(72) Inventor: Jeff Lee, Folsom, PA (US)

(73) Assignee: Jeff Lee, El Dorado Hills, CA (US)

( * ) Notice: Subject to any disclaimer, the term of this patent is extended or adjusted under 35 U.S.C. 154(b) by 81 days.

(21) Appl. No.: 15/722,221

(22) Filed: Oct. 2, 2017

(65) Prior Publication Data

US 2019/0098986 A1 Apr. 4, 2019

(51) Int. Cl.

| | |
|---|---|
| ***A45D 40/20*** | (2006.01) |
| ***A45D 40/22*** | (2006.01) |
| ***A61Q 19/00*** | (2006.01) |
| *A45D 40/00* | (2006.01) |

(52) U.S. Cl.

CPC ..... *A45D 40/22* (2013.01); *A61Q 19/001* (2013.01); *A45D 2040/0025* (2013.01)

(58) Field of Classification Search

CPC .... A45D 40/22; A45D 40/221; A45D 40/224; A45D 2040/0025

USPC ..... 401/88

See application file for complete search history.

(56) References Cited

U.S. PATENT DOCUMENTS

| | | | | |
|---|---|---|---|---|
| 5,025,817 | A * | 6/1991 | Wen | A45D 33/006 132/294 |
| 5,531,349 | A | 7/1996 | Wojcik | |
| 6,283,658 | B1 | 9/2001 | Estevez | |
| 8,888,391 | B2 | 11/2014 | Teller | |
| 9,060,586 | B1 * | 6/2015 | Erickson | A45D 40/00 |
| 2006/0005853 | A1 * | 1/2006 | Shen | A45D 33/008 132/296 |
| 2010/0054842 | A1 | 3/2010 | DeVito | |
| 2011/0011418 | A1 * | 1/2011 | Gatesoupe | A45D 33/006 132/293 |
| 2017/0354230 | A1 * | 12/2017 | Oh | A45D 34/00 |

* cited by examiner

*Primary Examiner* — Huyen D Le

(57) ABSTRACT

Disclosed is a lip balm applicator that can be used with just one hand. The applicator has a cover and base connected by a semi-flexible hinge. Within the base is a container for holding lip balm. The base and cover lock together when their edges are aligned and compressed, and they are opened by breaking the alignment. There are grips on the base for easy, one-handed manipulation of the applicator. Lip balm is applied by pressing the lips on the balm material in the container.

5 Claims, 1 Drawing Sheet

LIP BALM APPLICATOR

FIELD OF THE INVENTION

This invention relates generally to hand-held cosmetic containers and applicators, particularly devices which hold and apply lip balm.

BACKGROUND OF THE INVENTION

The following is a tabulation of some prior art that appears relevant:

| U.S. Patents | | | |
|---|---|---|---|
| Pat. No. | Kind Code | Issue Date | Patentee |
| 5,531,349 | | 1996 Jul. 2 | Wojcik |
| 6,283,658 | B1 | 2001 Sep. 4 | Estevez |
| 8,888,391 | B2 | 2014 Nov. 18 | Teller |

| U.S. Patent Application Publications | | | |
|---|---|---|---|
| Publication No. | Kind Code | Publ. Date | Applicant |
| 20100054842 | A1 | 2010 Mar. 4 | DeVito |

Lip balms have long been used for medicinal and cosmetic purposes. Typically, the balm consists of a semi-solid wax material, in stick form, that is contained within a tube. A mechanism on the tube is twisted or otherwise moved to project and retract the balm stick from, and back into, the tube. The end of the tube from which the balm stick is projected typically has a detachable cap. The problem with this system is that it takes two hands to apply the balm. One hand is needed to operate the twist mechanism to project the balm from the tube, and the other to hold the tube. There is also the problem of the cap, which must be removed and held, or placed to the side, further complicating one handed application, and creating the scenario for a lost cap.

Attempts have been made to change the dispensing mechanism to facilitate one-hand usage. Devito, et al., U.S. Pat. App. No. 2010/0054842 A1, discloses a slide device that would permit the projection and retraction of a solid substance out of and back into the container. However, the mechanics in the Devito invention are complicated and costly to manufacture. Plus, the system can only work with a small proportion of balm stick relative to the size of the containment vessel.

Wojcik, et al., U.S. Pat. No. 5,531,349, issued Jul. 2, 1996, discloses an auxiliary cap for use on pre-existing containers as a substitute for an original cap. This auxiliary cap has a hinged top which can be opened and closed with the thumb, but there is still the problem of the device coming loose and getting lost. There is also the problem of accurately fitting the device to different tube circumferences. The Wojick device also fails to solve the problem of projecting the balm with one hand.

Estevez, et al., U.S. Pat. No. 6,283,658 B1, issued Sep. 4, 2001, discloses a non-detachable cap which can be opened by a sliding device, but it does not solve the projection problem, relying on the old-style twist mechanism from the bottom of the container. Also, the mechanism for popping the cap involves numerous parts, driving up the cost of production and increasing the risk of malfunction.

Teller, et al., U.S. Pat. No. 8,888,391 B2, issued Nov. 18, 2014, discloses a spherical lip balm container consisting of a base and detaching cover. The balm arches above the opened top of the base container, obviating any need for an ejection/retraction device. However, the top is detached, preventing one-handed use.

SUMMARY OF THE INVENTION

This invention is a lip balm applicator which can be used with one hand. The lip balm applicator is comprised of a base, a container situated within the base, and a cover. The base and cover are made of a semi-flexible material and are connected by a semi-flexible hinge. There is a latching means along the edges of the base and cover whereby alignment and compression of the edges closes and locks the two parts. The latching means is susceptible to opening when the alignment of the base and cover is broken. Both opening and closing the applicator can be accomplished with one hand. The container in the base holds lip balm. The lip balm is secured by ridging on the bottom of the container. When the device is open, the user's lips are pressed against the exposed balm. Only one hand is needed to open the device, to apply the balm, and to close the device.

DETAILED DESCRIPTION OF INVENTION

Figure 1:
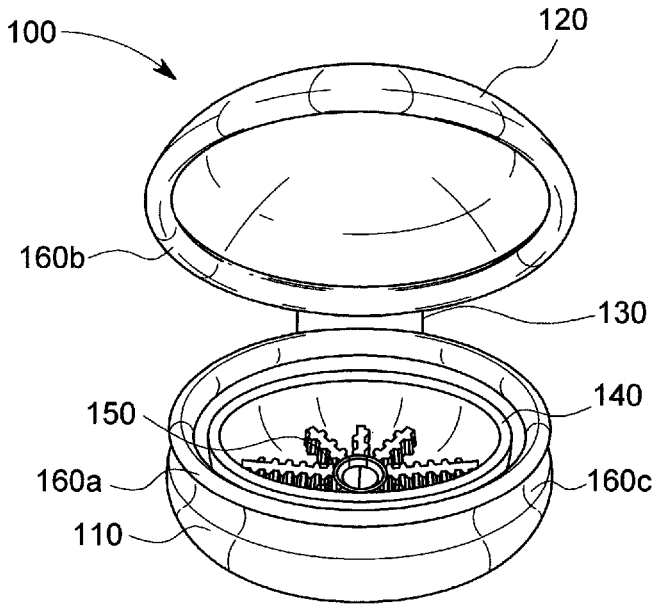
FIG. 1 is a front view of the invention in its open position.

The invention is best understood by reference to the drawings. FIG. 1 shows a front view of the invention in its open position 100. There is a base 110 and a cover 120. The base and cover are connected by a hinge 130. Within the base is a container 140 for the storage of lip balm. The lip balm is secured to the container by ridges on the container's bottom 150. There is a base latching means 160*a* comprising a chordal ridge running along the outer edge of the base, and a cover latching means 160*b* comprising a chordal ridge running along the inner edge of the cover. The cover 120 is slightly larger than the base 110 so that the cover latching means 160*b* slides over and locks below the base latching means 160*a*. There is a leverage depression 160*c* below the base latching means 160*a* comprising a concave belt around the base. The leverage depression 160*c* provides space and leverage for the user's fingers to more easily open, close, and otherwise manipulate the applicator.

Figure 2:
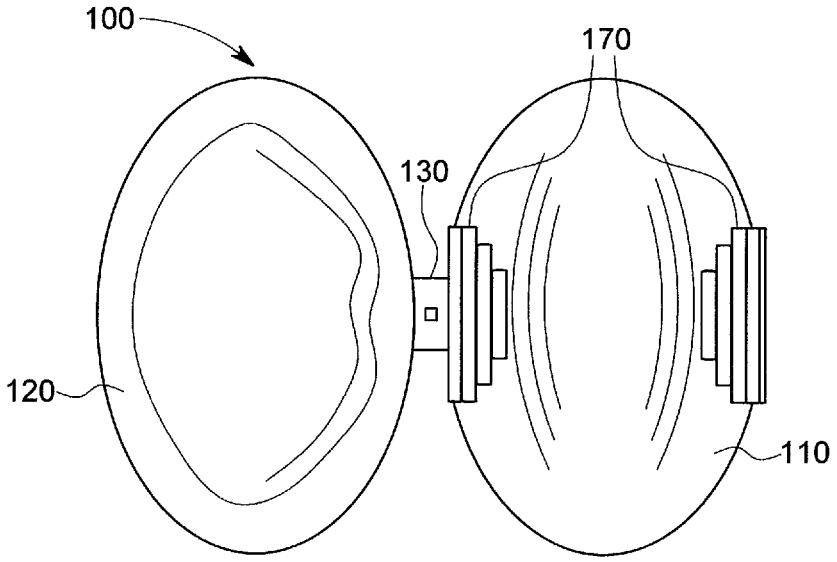
FIG. 2 is a rear view of the invention in its open position.

FIG. 2 shows the outer surfaces of the base 110 and the cover 120 in the open position. A gripping means 170, comprised of sets of ridges, are visible on the base 110. The hinge is also visible 130.

I claim:

1. A lip balm applicator, comprising (a) a base, comprising one half of a spheroid divided along its longitudinal axis, (b) a container, comprising a structure with a shape substantially like that of the base, but smaller, and being attached on its convex side to the concave side of the base, (c) a balm anchor, comprising raised structures on the bottom of the container, (d) a cover, comprising a structure with a shape substantially like that of the base, but larger, (e) a hinge, comprising a flat rectangular structure made of a semi-flexible plastic, for connecting the cover and the base, (f) a cover latching means, comprising a chordal ridge running along the inner edge of the cover, (g) a base latching means, comprising a chordal ridge running along the outer edge of the base, (h) a gripping means, comprising a set of ridges on the outer surface of the base.

2. A lip balm applicator as claimed in 1, in which the base and the cover are comprised of a semi-flexible plastic.

3. A lip balm applicator as claimed in 1, in which the container and the balm anchor are comprised of a rigid plastic.

4. A lip balm applicator as claimed in 1, in which the base, the cover, the container, and the balm anchor are comprised of a rigid plastic.

5. A lip balm applicator as claimed in 1, in which there is a leverage depression on the base, said leverage depression comprising a concavity circumventing the base below and adjoining the base latching means.

* * * * *